US012135197B2

(12) United States Patent
Gaide

(10) Patent No.: US 12,135,197 B2
(45) Date of Patent: Nov. 5, 2024

(54) AMMUNITION CARTRIDGE

(71) Applicant: Rabuffo SA, Monnaz (CH)

(72) Inventor: Albert Gaide, Monnaz (CH)

(73) Assignee: Rabuffo SA, Monnaz (CH)

( * ) Notice: Subject to any disclaimer, the term of this patent is extended or adjusted under 35 U.S.C. 154(b) by 0 days.

(21) Appl. No.: 17/616,722

(22) PCT Filed: Jun. 7, 2019

(86) PCT No.: PCT/EP2019/064927
§ 371 (c)(1),
(2) Date: Dec. 6, 2021

(87) PCT Pub. No.: WO2020/244773
PCT Pub. Date: Dec. 10, 2020

(65) Prior Publication Data

US 2022/0299303 A1 Sep. 22, 2022

(51) Int. Cl.

| | |
|---|---|
| ***F42C 19/08*** | (2006.01) |
| ***F42B 5/16*** | (2006.01) |
| ***F42B 10/40*** | (2006.01) |
| *F42B 5/285* | (2006.01) |

(52) U.S. Cl.
CPC ..... *F42C 19/0826* (2013.01); *F42B 5/16* (2013.01); *F42B 10/40* (2013.01); *F42C 19/0834* (2013.01); *F42B 5/285* (2013.01)

(58) Field of Classification Search
CPC ..... F42B 5/025; F42B 5/285; F42B 5/307; F42B 10/40; F42B 10/44; F42B 5/02; F42B 5/00; F42B 5/16; F42C 19/0826; F42C 19/083
See application file for complete search history.

(56) References Cited

U.S. PATENT DOCUMENTS

| | | | | |
|---|---|---|---|---|
| 1,920,075 A * | 7/1933 | Haenichen | ..... | F42C 19/0826 102/443 |
| 2,382,118 A | 8/1945 | Weinberger | | |
| 2,493,938 A * | 1/1950 | Albree | ..... | F42C 19/0826 102/439 |
| 4,823,699 A | 4/1989 | Farinacci | | |
| 4,887,534 A * | 12/1989 | Dickovich | ..... | F42C 19/0826 102/373 |

(Continued)

FOREIGN PATENT DOCUMENTS

| | | | | |
|---|---|---|---|---|
| DE | 3703898 | 8/1988 | | |
| DE | 3719648 A1 * | 12/1988 | ..... | F42C 19/0826 |

(Continued)

OTHER PUBLICATIONS

International Search Report and Written Opinion issued by the European Patent Office, dated Jan. 24, 2020, for International Patent Application No. PCT/EP2019/064927; 21 pages.

*Primary Examiner* — Jonathan C Weber
(74) *Attorney, Agent, or Firm* — Faegre Drinker Biddle & Reath LLP

(57) ABSTRACT

Ammunition cartridge comprising a rigid casing including a tubular sleeve and a base closing an end of the casing, a projectile mounted at another end of the casing, a propellant charge contained inside the casing, and an ignition device. The ignition device comprises an ignition charge arranged to ignite the propellant charge at a point of ignition distal from the base and proximal the projectile.

17 Claims, 9 Drawing Sheets

(56) References Cited

U.S. PATENT DOCUMENTS

| | | | | | |
|---|---|---|---|---|---|
| 5,400,715 | A * | 3/1995 | Roach | F42C 19/0826 | 102/431 |
| 5,421,264 | A | 6/1995 | Petrick | | |
| 6,158,348 | A * | 12/2000 | Campoli | F42C 19/0826 | 102/434 |
| 9,249,759 | B1 * | 2/2016 | Einstein | F42C 19/0826 | |
| 10,415,938 | B2 * | 9/2019 | Mohler | F42C 19/0826 | |
| 10,627,200 | B1 * | 4/2020 | Hirlinger | F42B 5/28 | |
| 11,143,493 | B2 * | 10/2021 | Gaide | F42B 5/10 | |
| 2002/0124760 | A1 * | 9/2002 | Brion | F42B 5/181 | 102/470 |
| 2002/0195017 | A1 | 12/2002 | Priimak | | |
| 2004/0003746 | A1 * | 1/2004 | Niemeyer | F42B 5/181 | 102/439 |
| 2006/0096485 | A1 * | 5/2006 | Stark | F42C 19/0826 | 102/431 |
| 2007/0289474 | A1 | 12/2007 | Mutascio | | |
| 2013/0305950 | A1 | 11/2013 | Coffman | | |
| 2018/0292186 | A1 | 10/2018 | Padgett | | |
| 2019/0033045 | A1 * | 1/2019 | Mohler | F42C 19/0826 | |

FOREIGN PATENT DOCUMENTS

| | | | | |
|---|---|---|---|---|
| SE | 461682 B * | 3/1990 | | F42C 19/0826 |
| WO | WO-2019110614 A1 * | 6/2019 | | F42B 10/04 |

* cited by examiner 6
35
38
40
37
16
33
52
14
36
22
34
10
32
30
46
61
58
28
6
2
16
14

AMMUNITION CARTRIDGE

CROSS-REFERENCE TO RELATED APPLICATIONS

The present application is a national stage entry of International (PCT) Patent Application Number PCT/EP2019/064927, filed Jun. 7, 2019, the subject matter of which is expressly incorporated herein by reference.

FIELD OF THE INVENTION

This invention relates to an ammunition cartridge for rifles and firearms.

BACKGROUND OF THE INVENTION

Conventional ammunition cartridges for firearms and guns of various sizes and purposes typically comprise a brass casing containing a propellant charge in the form of powder or to granules of an explosive substance, and a projectile assembled in a gripping fit at an open tubular sleeve end of the casing. Although various ignition systems have been developed, the most common ignition systems for ammunition cartridges comprise an ignition charge mounted in a primer cap located on the casing base wall that ignites upon impact by a firing pin of the weapon. The ignition charge ignites the propellant charge whereby during the explosion the projectile is accelerated in the barrel of the weapon. Since the ignition of the propellant starts from the base wall of the cartridge, propellant powder is ejected from the casing during combustion, a portion of the propellant substance finishing its combustion in the barrel chamber of the weapon. In many instances unburned grains may even be expelled.

The pressure generated by combustion of the propellant substance must not exceed a certain level in order to prevent damage to the weapon. In many conventional weapons the pressure generated by the combusting propellant should not exceed around 4000 bars. This limits the propulsion force that the propellant charge can impart. Moreover, in conventional ammunition cartridges, the propellant is often not optimally consumed. Due to the projection of propellant substance out of the casing the combustion of the substance occurs at lower temperatures. It also may depend to a certain extent on the characteristics of the weapon, in particular manufacturing tolerances and wear that influences the fit between the projectile and the barrel chamber and the fit between the casing and the combustion chamber.

One important factor to consider in the design of an ammunition cartridge is the safety of the ammunition when stored or being loaded in a weapon, in particular to avoid any inadvertent firing of the ammunition.

SUMMARY OF THE INVENTION

In view of the foregoing it is an object of the invention to provide an ammunition cartridge with improved performance, in particular that allows to generate a high and well controlled acceleration of the projectile without exceeding the chamber pressure tolerance, and that is safe to use.

It is advantageous to provide an ammunition cartridge that is light, compact, and uses less materials for a given performance.

It is advantageous to provide improved ammunition cartridges that can be used in existing weapons.

Objects of this invention have been achieved by providing the ammunition cartridge according to the claims.

Dependent claims recite various advantageous features or variants.

Disclosed herein, is an ammunition cartridge comprising a rigid casing including a tubular sleeve and a base closing an end of the casing, a projectile mounted at another end of the casing, a propellant charge contained inside the casing, and an ignition device arranged to ignite the propellant charge at a point of ignition distal from the base and proximal the projectile, the ignition device comprising a first ignition charge positioned in an ignition cap located in the base actuable by means of a firing pin or hammer impacting the ignition cap.

According to a first aspect of the invention, the ignition device further comprises a guide channel extending from the ignition cap to an ignition end proximal the projectile, the guide channel configured to channel an ignition charge under combustion to one or more nozzles at said ignition end, or to guide an ignition pin to said ignition end to ignite a second ignition charge mounted proximal the projectile, wherein the guide channel comprises a movable portion configured to retract upon accidental insertion of the projectile into the casing.

According to a second aspect of the invention, the propellant charge comprises a plurality of charge portions with different combustion characteristics, the plurality of charge portions being arranged at least partially concentrically with respect to each other.

In an embodiment, the guide channel comprises a fixed portion and a movable portion coupled to the fixed portion.

In an embodiment, the movable portion is axially slidably mounted on the fixed portion.

In an embodiment, the movable portion is connected to the fixed portion via a frangible or pliable coupling.

In an embodiment, the propellant charge comprises a plurality of portions of different composition or different densities with different combustion characteristics, in particular that retard or accelerate the combustion process.

In an embodiment, the propellant charge comprises a plurality of portions separated by at least one combustion speed regulation material selected to either retard or to accelerate combustion.

In an embodiment, the propellant charge is in a solid self-supporting preform, comprising a combustion powder held together with a binding material.

In an embodiment, the propellant charge comprises a concave face facing towards the point of ignition.

In an embodiment, the ammunition cartridge further comprises a combustible charge positioned adjacent a trailing end of the projectile, the combustible charge forming either a projectile booster charge and/or the second ignition charge.

In an embodiment, said combustible charge is positioned in a cavity in the trailing end of the projectile.

In an embodiment, said combustible charge is mounted in a tubular holder.

In an embodiment, the tubular holder comprises a tapered or conical entry portion at a rear end.

In an embodiment, the point of ignition is separated by a thin film from the propellant charge.

In an embodiment, the casing is made of at least two parts including the base and the tubular sleeve that are assembled together.

In an embodiment, said base and tubular sleeve are welded together.

In an embodiment, the plurality of charge portions comprise different compositions and/or different densities that retard or accelerate the combustion process.

In an embodiment, the guide channel comprises a nozzle directed axially towards a rear end of the projectile.

In an embodiment, the rear end of the projectile is configured to bounce the ignition charge under combustion backwards off the rear end and on to a front surface of the propellant to ignite it.

Further objects and advantageous aspects of the invention will be apparent from the claims, and from the following detailed description and accompanying figures.

BRIEF DESCRIPTION OF THE DRAWINGS

The invention will now be described with reference to the accompanying drawings, which by way of example illustrate embodiments of the present invention and in which.

DETAILED DESCRIPTION OF EMBODIMENTS OF THE INVENTION

Figure 1A:
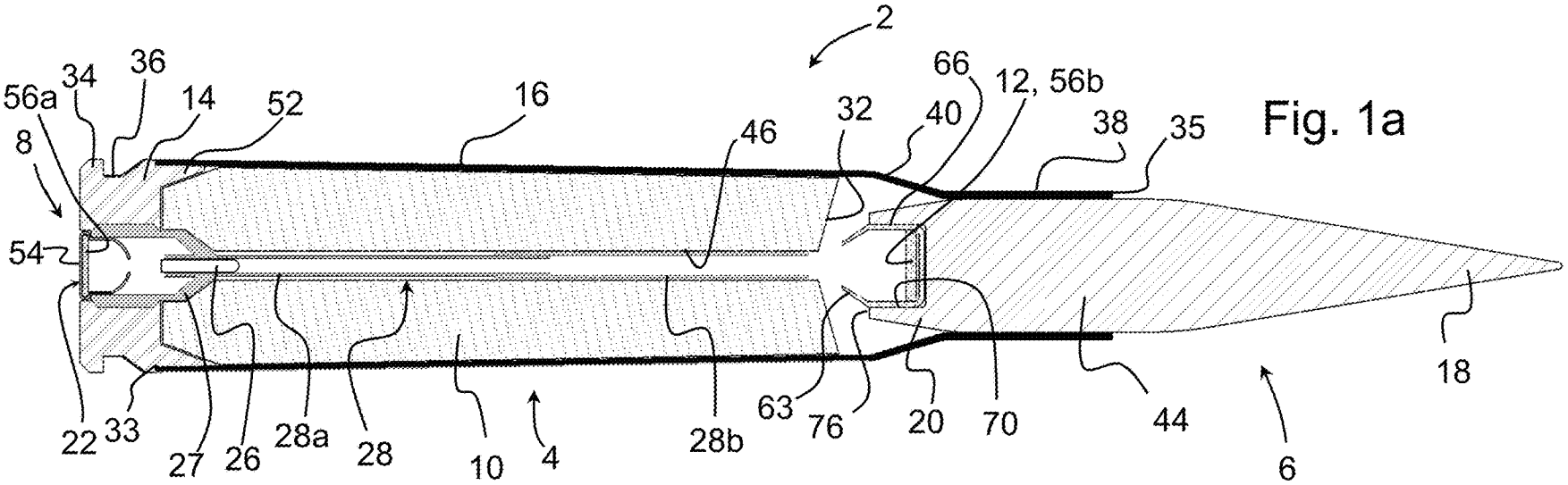
FIG. 1*a* is a schematic cross-sectional view of an ammunition cartridge according to an embodiment of the invention.

Referring to the figures, an ammunition cartridge 2 comprises a casing 4, a projectile 6, an ignition device 8, and a propellant charge 10. The projectile 6 may have various materials and geometric properties that are per se known in the field of ammunition cartridges and has a diameter configured for a barrel chamber of a weapon. The ammunition cartridge outer shape and dimensions may be configured to conform to a standard size for use with existing small firearms and rifles, in replacement of existing ammunitions cartridges.

The casing 4 generally has a cylindrically shaped tubular sleeve 16 closed at one end by a base 14 at the opposed open end receiving the projectile 6. The projectile receiving end, as is well-known in the art, comprises a neck portion 38 connected via a tapered portion to a major portion 37 of the tubular sleeve portion containing the propellant charge 10, the neck portion 38 having a smaller diameter than the major portion 37. The outer shape of the base may have various configurations depending on the weapon with which it is intended to be used, and may for instance typically comprise a rim 34 and annular groove 36 that serve to eject the casing from the firing chamber of the weapon as is per se well-known in the art.

In an embodiment of the present invention, the casing 4 may be made of a single piece part, for instance a single piece metal part, according to conventional manufacturing processes.

In an advantageous embodiment, the casing may be made of two or more parts, with at least a cylindrical body or sleeve and a base, that are assembled together, by welding, soldering, crimping or other per se known assembling techniques. The multi-part casing allows assembly of the propellant charge 10 into the casing tubular sleeve from the base end 33 before assembly of the base 14 to the tubular sleeve 16, or in a conventional manner from the open neck end 35 once the multi-part casing is assembled. The base 14 may be provided with a tubular connection portion 52 that inserts in the open base end 33 of the tubular sleeve 16 and may be welded by various welding techniques such as Laser welding, Electron-beam welding, friction welding, induction welding and other known welding techniques. The two parts may also be crimped together.

The propellant charge 10 may be in the form of powder or granules as per se known in the art. In an advantageous embodiment according to this invention, the propellant charge is bound in a preform that forms a solid body insertable into the tubular sleeve 16 of the casing 4. The preform may comprise a combustible substance bound together with a binding material. In a variant, the preform may comprise a thin shell, for instance of a polymeric material, containing the propellant charge therein. In the latter variant, the propellant charge may be a solid preform, in loose granules, or in a liquid or gel form.

Various substances with binding properties may be used such as resins, plastics, or asphaltics that hold together a charge of finely divided particles and increase the mechanical strength of the resulting propellant block. Propellants in granular or even liquid form can also be enclosed in a thin shell with a single or various compartments and a closing cap.

The propellant that has exclusively been used for a long time in conventional military weapons is the so-called smokeless powder or "Gun Powder". Whether single-base powder (e.g. nitrocellulose), double-base powder (e.g. nitrocellulose plus nitroglycerine) or triple-base powder (e.g. nitrocellulose plus nitroglycerine plus nitroguanidine) these propellants undergo a variety of manufacturing processes providing a pasta-like colloidal mixture of thermoplastic behavior that can be extruded through a variety of dies or mechanically pressed into forms.

The more recent development of low-vulnerability ammunition (LOVA) has led to the use of plastic propellants. They are embedded in curable plastics, thermoset materials, thermoplasts or gelatinizers to form a mixture that can be given various shapes by means of hydraulic mold presses and cutting machines for example. LOVA powders correspond to the traditional Gun Powders and can be adapted according to the desired ballistic characteristics. Propellants can also be mixed with or embedded in various curable or poly-additive plastics such as polysulfides, polyurethane, acrylic acid and the like, or mixed with Silicon, petroleum jelly or gelatinized compounds of plastiline like consistency and given a variety of desired forms. Pre-forming may not be limited to the external dimensions and shapes, it can also include embedded details such as cylindrical or conical apertures that increase the combustion surface and contribute in the steady production of gas.

The propellant charge preform may be formed as an individual component that is inserted and assembled to the other components of the ammunition cartridge. In a variant, the propellant charge preform may be formed directly within the cylinder portion of the casing. In a variant, the propellant charge preform may be formed around the ignition device before assembly into the casing. In a variant, propellant charges can be filled in the casing between pre-inserted thin discs or cylindrical walls that have been forced in the casing shell and act as separators. When the propellant is of granular, gelatinous or viscous nature, the preform may also be surrounded partially or fully by a coating, film or thin layer of material, or a thin shell, that keeps or helps to keep the preform in its intended shape for assembly. The layer of material may for instance be polymer based, paper based, starch based, or gelatinized. In the latter variants, the propellant charge within the center of the preform may be generally loose or held together with a binder material.

The principle purpose of the preform is to allow assembly within the casing, however depending on the embodiment, the binding properties of the preform do not necessarily need to withstand transport and shock once the ammunition cartridge has been fully assembled.

Although the projectile 6 may adopt an essentially conventional shape and use conventional materials as per se well-known in the art, according to an advantageous embodiment of the invention allowing a larger free space inside the cartridge, the projectile may comprise tail fins 64 on the trailing side of the projectile. The fins are configured aerodynamically to provide stable flight to the projectile for use with a weapon with a smooth barrel chamber. In a variant, the fins may be configured to impart a rotational spin to the projectile for use with a smooth barrel chamber of a weapon.

According to an aspect of the invention, the ignition device comprises a point of ignition 23 that is at a position distal from the base 14 and proximate the projectile 6.

The ignition device 8 extends from an actuation end 54 positioned on the base 14 of the casing 4, to an ignition end 24 forming the point of ignition that is positioned distal from the base and proximate the projectile 6, configured to ignite the propellant 10 at a position distal from the base 14 and proximate the projectile 6.

According to the invention, the propellant thus combusts starting from a position proximate the projectile 6 and thus proximate the neck portion 38 of the casing to generate gas, the direction of combustion moving like in a rocket engine from the projectile end 35 towards the base such that combustion of the propellant occurs within the casing 16 because the pressure generated will oppose the un-combusted propellants from moving into the barrel as this is the case when ignition occurs in the base part of the cartridge.

Figure 5A:
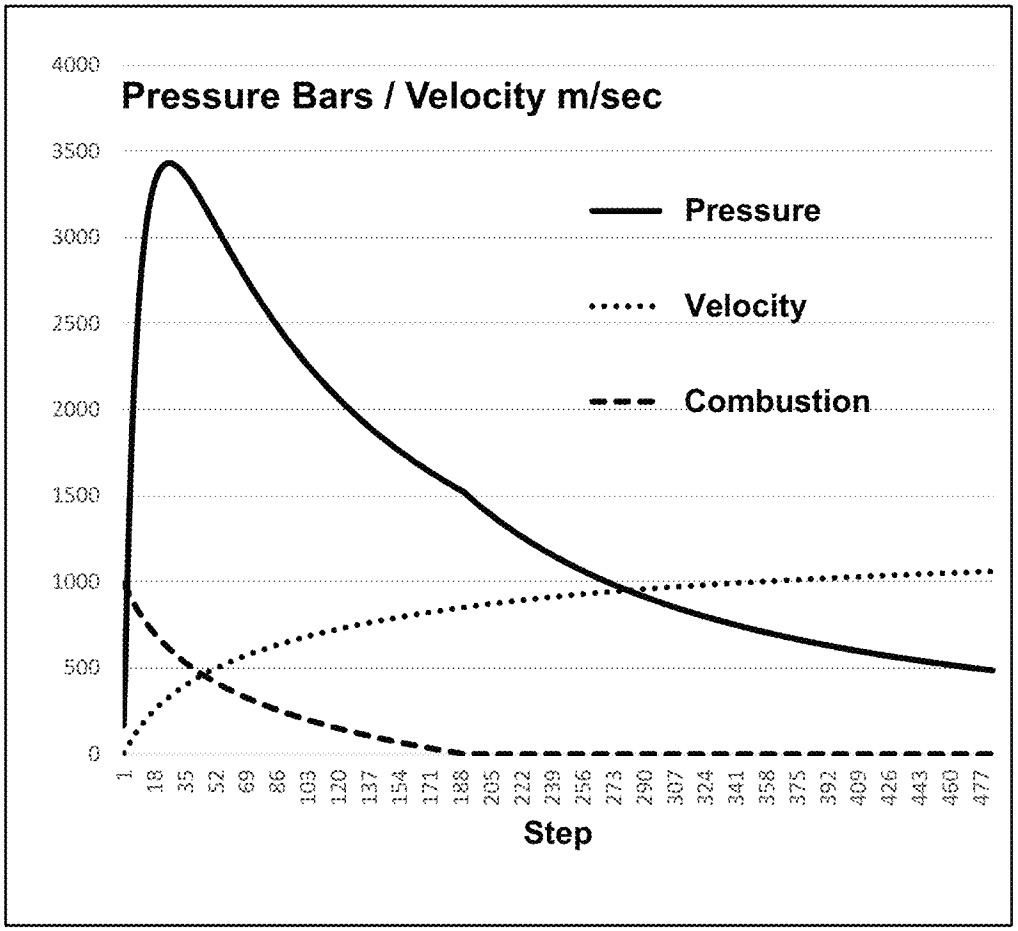
FIG. 5*a* is a graphical representation of the pressure, velocity and combustion profiles of a simulated combustion process using a single propellant and a traditional ignition at the base of the cartridge.

FIG. 5*a* shows the pressure, velocity and combustion profiles derived from a numerical simulation model of the interior ballistic process in the case of a traditional ignition at the base of the cartridge. The combustion profile shows that the propellant ends burning when the projectile has progressed about a third of the barrel length, which means that gun powder propelled with the projectile burns to a large extent in the lower part of the barrel.

According to embodiments of the invention, preventing un-combusted propellants to move into the barrel very advantageously ensures a better control of the combustion and the projectile acceleration process. Since un-combusted propellant is not projected into the barrel chamber of the weapon its combustion does not occur at a lower temperature and it does not absorb part of the kinetic energy transferred to the projectile within the barrel chamber. As the combustion of the propellant occurs essentially within the casing, the projectile is displaced in the barrel with a greater rate of progression than with a conventional ignition starting from the base wall. Since the propellant (which would otherwise be displaced in a conventional ignition) can represent a two-digit percentile of the total mass propelled in the barrel, the projectile according to embodiments of the invention, receives an additional propulsion of corresponding kinetic energy. This can either be useful to increase the speed of the projectile, or for a projectile to be propelled at a given speed, to reduce the volume of the propellant charge required and thus if wanted, the size of the ammunition cartridge.

Ignition of the propellant charge 10 at a position proximal the projectile 6 may be achieved in various manners according to embodiments of the invention.

The ignition device 8 comprises an ignition charge 56*a* (a first ignition charge) mounted in an ignition cap 22. Firing of the ammunition cartridge is executed by a firing pin or hammer of a conventional rifle or pistol that hits the ignition cap 22 on the base wall 14. When a base of the ignition cap is deformed by the weapon's firing hammer or pin, a first ignition charge 56*a* in the ignition cap 22 is ignited similar to a conventional ammunition cartridge ignition process.

Figure 1B:
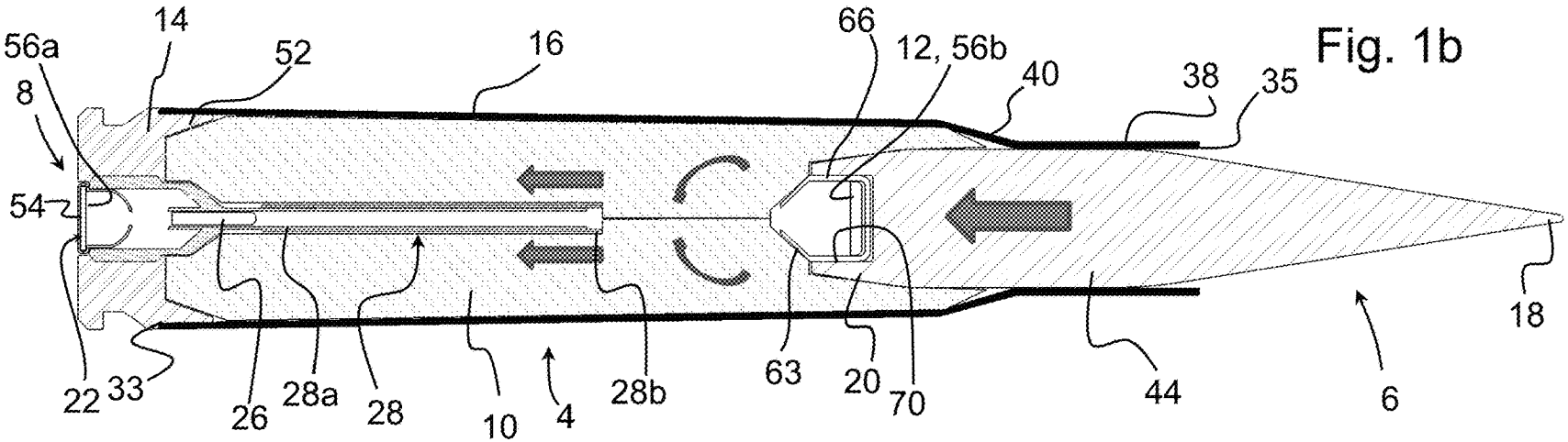
FIG. 1*b* is a cross-sectional view of the ammunition cartridge of FIG. 1 showing the projectile accidentally pushed inwards.
Figures 2A, 2B:
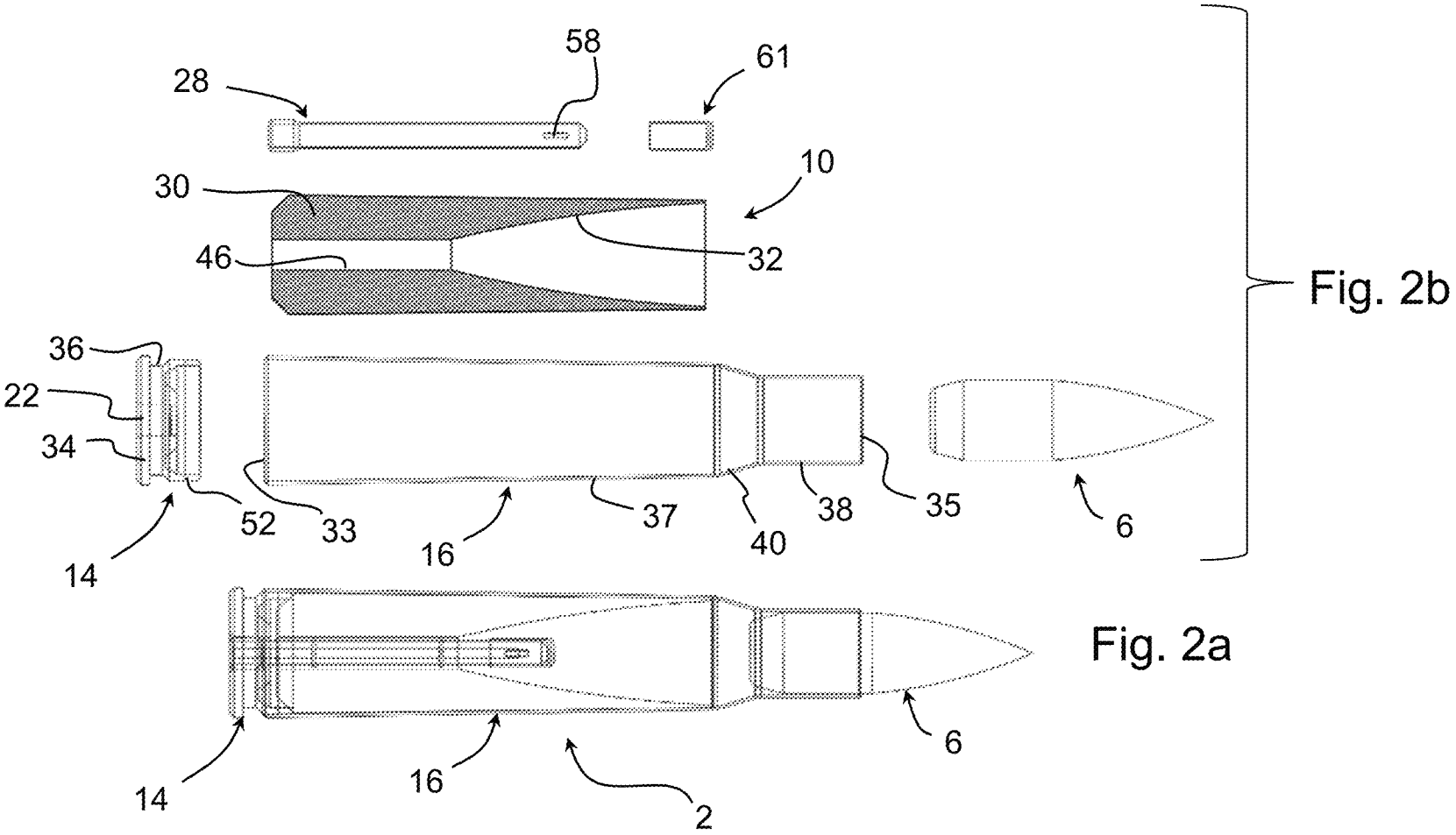
FIG. 2*a* is a view of an ammunition cartridge, illustrated with transparency to show internal parts, according to an embodiment of the invention.
FIG. 2*b* shows the disassembled parts of the cartridge of FIG. 2*a;*

In an embodiment as schematically illustrated in FIGS. 1*a* and 1*b*, the ignition device comprises an ignition pin 26 slidably mounted in a tubular guide channel 28 extending from the base 14 to an ignition charge proximal or on the projectile 6 that forms the point of ignition.

In a first embodiment, the expanding gas of the first ignition charge propels an ignition pin 26 along the guide channel 28 towards a second ignition charge 56*b*. The second ignition charge 56*b* is ignited by impact of the ignition pin 26 therewith. A face 32 of the propellant charge 10 is ignited by the second ignition charge and thus propels the projectile 6 along the barrel of the weapon.

In a second embodiment, the expanding hot gas of the first ignition charge under combustion is channeled by the guide channel 25 to one or more nozzles 58 at the ignition end 24 of the guide channel 28 that ignite the propellant charge 10 proximal the projectile 6, the nozzles thus forming the point of ignition in this embodiment.

The nozzles 58 may for instance comprise a plurality of at least partially radially directed nozzles to direct the combustion gases of the first ignition charge to the front surface 32 of the propellant.

In a variant, the nozzle may be directed axially to ignite an ignition charge 56*b* or projectile booster charge 12 mounted on the rear end of the projectile 6.

Figure 3D:
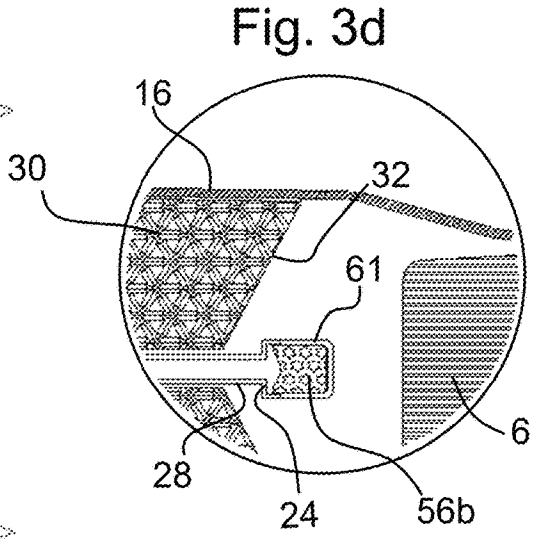
FIG. 3*d* is a detail schematic cross-sectional view of an ignition end of an ammunition cartridge according to an embodiment of the invention.
Figure 3E:
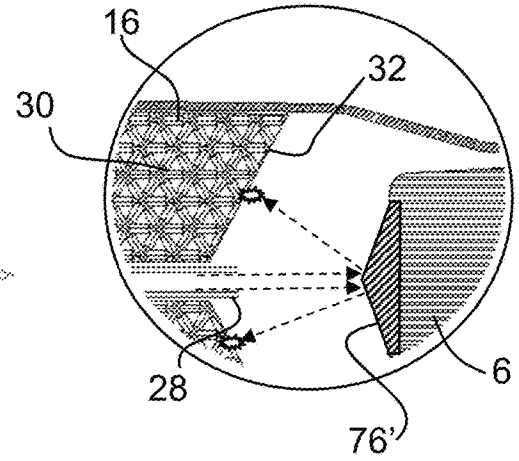
FIG. 3*e* is a detail schematic cross-sectional view of an ignition end of an ammunition cartridge according to another embodiment of the invention.

In a variant without booster charge, the nozzle may be directed axially towards a rear end 76' of the projectile 6, as best illustrated in FIG. 3*e*, configured to bounce backwards (i.e. reflect) off the rear end 76' and on to the front surface of the propellant 10 to ignite it. An advantage of this embodiment is the simplicity of the construction and the low assembly and manufacturing cost.

In a variant, the first ignition charge may ignite a second ignition charge mounted at the end of the guide channel proximal the projectile.

The guide channel comprises a tubular sleeve of material, such as a hollow polymer or metal tube.

In a first embodiment, the guide channel may comprise a first fixed portion 28*a* and a second mobile portion 28*b*. The second mobile portion may be telescopically (i.e. slidably) mounted on the fixed portion.

In an embodiment, the fixed portion 28*a* is integrally formed with, or rigidly connected to a base portion 27 that is anchored in the base wall 14 and that surrounds the ignition cap 22. The funnel shaped chamber formed by the base portion 27 funnels the combustion gas of the ignition charge into the tubular channel 28.

In a variant (not shown), the mobile portion may comprise a cap closing the end of the mobile channel portion proximate the projectile, the cap forming an ignition tip whereby the expanding combustion gas of the first ignition charge thus exerts pressure on the cap and propels the mobile portion towards a second ignition charge 56*b*. The second ignition charge 56*b* is ignited by impact of the cap of the mobile portion therewith. A face 32 of the propellant charge 10 is ignited by the second ignition charge and thus propels the projectile 6 along the barrel of the weapon.

In a second embodiment, the guide channel may comprise at least a portion thereof that is pliable in the axial (i.e. projectile firing) direction, or that comprises a frangible connection such that at least a portion of the guide tube is movable backwards if impacted by rupture of the frangible portion.

In all of the above embodiments, at least a portion of the guide channel 28 is movable axially backwards (i.e. in a direction opposite the projectile firing direction) in case of being pushed back by the projectile 6, in order to ensure that no ignition charges 56*a*, 56*b*, 12 are inadvertently ignited by impact with the guide channel 28. The movement may be by a portion of the guide channel tube sliding, or by an elastic or permanent deformation of at least a portion of the guide channel tube, or by a rupture (breaking) of at least a portion of the guide channel tube.

In embodiment comprising an ignition pin 26, the ignition pin 26 has a length that is less than the length of the cartridge casing tubular sleeve 16 minus the length of the projectile 6, such that if the projectile is pushed into the cartridge accidentally, the second ignition charge is not ignited accidentally by being pushed back upon the tip of the ignition pin 26.

Accidental pushing backwards of the projectile 6 in the casing 4 of the cartridge can for instance occur when a round of ammunition is not fully inserted in the gun barrel and the tip pushes against a shoulder while the bolt presses on the cartridge casing. Accidental pushing of the projectile into the cartridge casing may also occur under various other circumstances such as impact of ammunition with external objects during transport or mobile elements entering into contact with stored ammunition. FIG. 1*b* illustrates an instance of accidental pushing backwards of a projectile 6 into a casing 4.

The ignition device may further comprise a cap 61 as illustrated in FIG. 3*d*, for instance made of a plastic or paper-based material that closes the ignition end 24 of the guide channel 28 to prevent propellant charge substance from entering the guide channel 28. The cap 61 may be pierced or ruptured by the pin or by the expanding ignition charge.

Figure 4A:
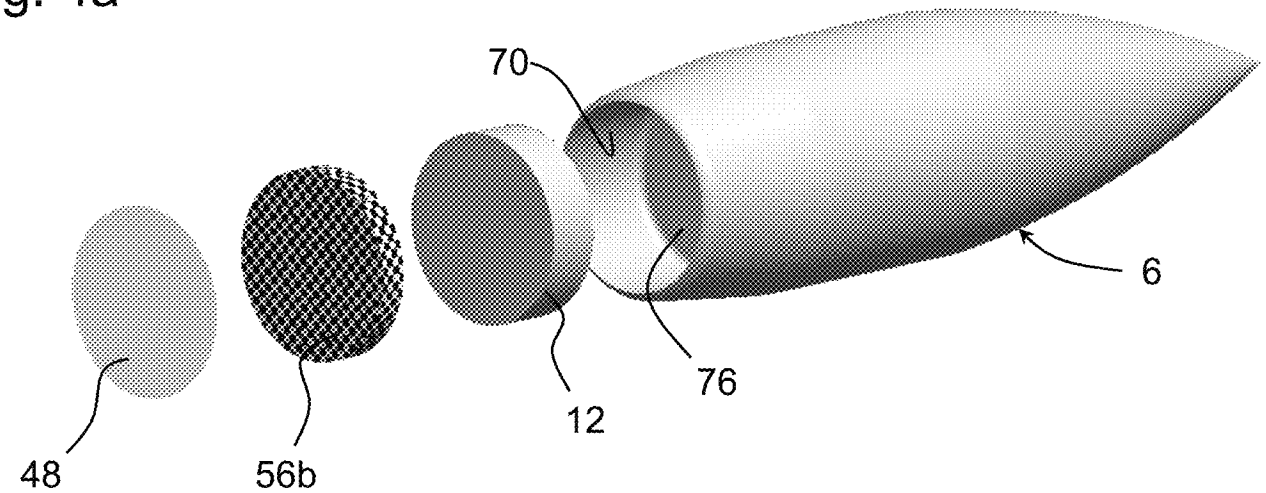
FIG. 4*a* is perspective schematic view of a projectile with an ignition charge and a booster charge of an ammunition cartridge according to an embodiment of this invention.
Figure 4B:
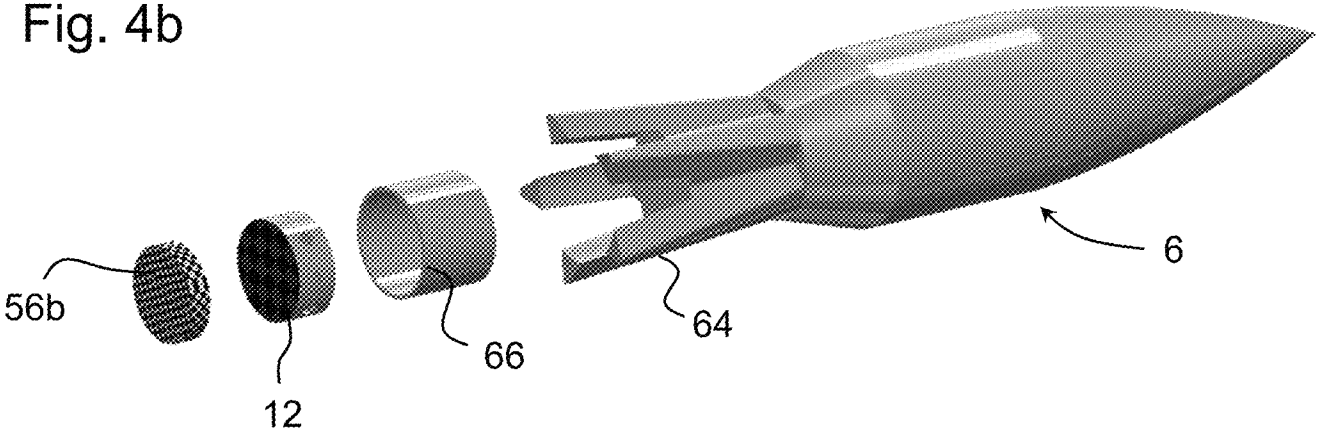
FIG. 4*b* is a schematic perspective view of a projectile with an ignition charge and a booster charge of a cartridge according to another embodiment of the invention.

Referring now to FIG. 4*b*, in an advantageous embodiment, the second ignition charge 56*b* can be positioned in the trailing end 75 of the projectile. This arrangement offers a simple way of holding the second ignition charge in the front part of the cartridge and provides an important safety measure. The cartridge can be filled with propellant and can be assembled without the presence of sensitive ignition materials that may detonate if un-advertently mishandled. With an ignition charge located in the base of the projectile the sensitive ignition charge can be inserted at the last assembly step.

Referring now to the embodiments illustrated in FIGS. 3*a* to 3*c*, and FIGS. 6*a*, 6*b*, in an advantageous configuration, the propellant charge may comprise a plurality of portions 10*a*, 10*b*, 10*c*, 10*d* of different composition or densities or structural properties, configured to provide different combustion characteristics. Concave/Convex forms increase the interface between charges and with flat interfaces combustion will transfer at the end of the combustion of the previous charge.

Figure 3A:
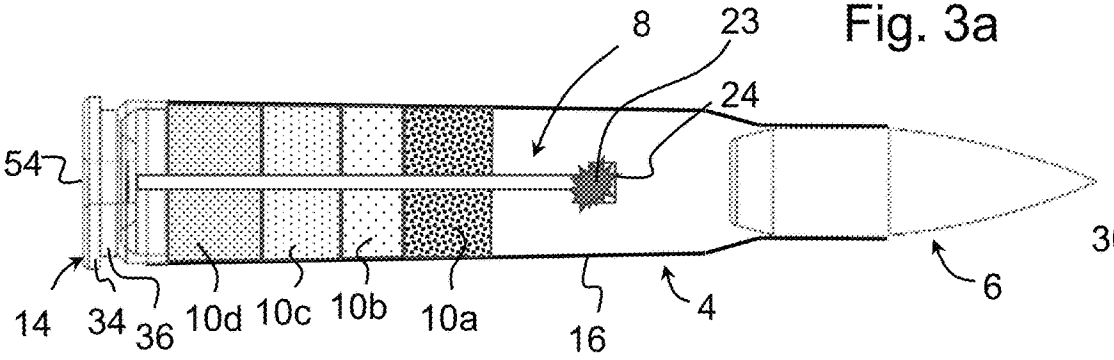
FIG. 3*a* is a schematic cross-sectional view of an ammunition cartridge according to another embodiment of the invention.
Figure 3B:
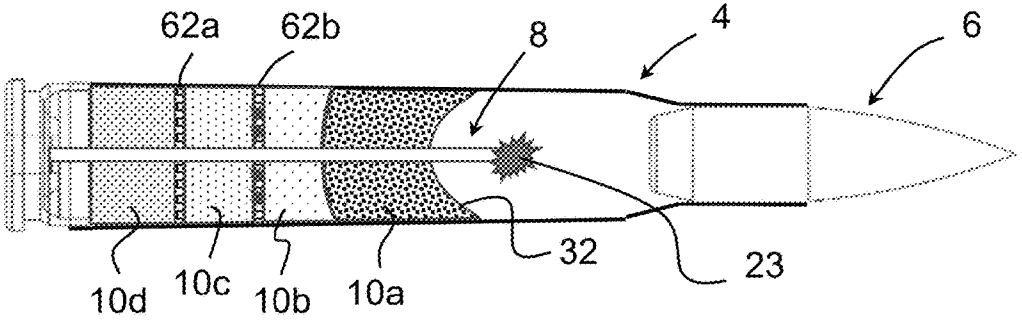
FIGS. 3*b* and 3*c* are schematic cross-sectional views of ammunition cartridges similar to FIG. 3*a* showing variants.
Figure 3C:
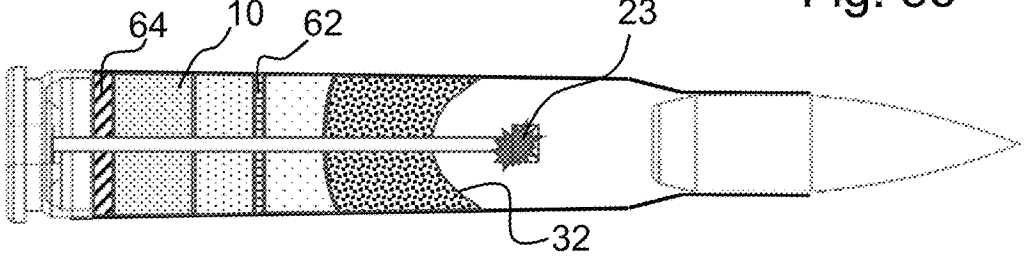

In the embodiments illustrated in FIGS. 3*a* to 3*c*, the propellant charge portions 10*a*-10*d* are arranged stacked in the axial direction (i.e. the direction of displacement of the projectile 6) and thus combust substantially sequentially during the combustion of the propellant charge.

Figure 6A:
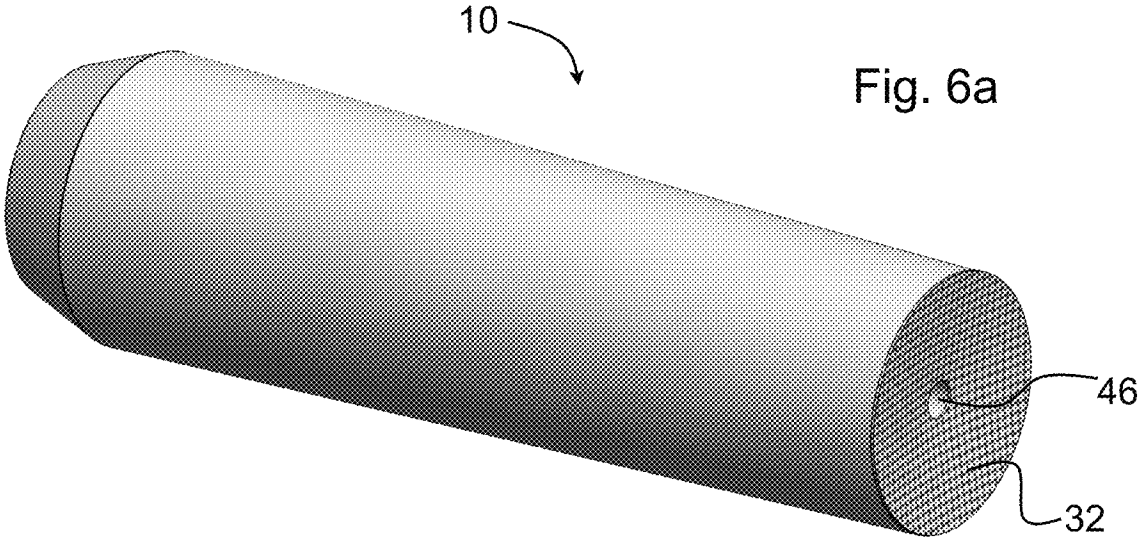
FIGS. 6*a* and 6*b* are schematic views in perspective (FIG. 6*a*) and longitudinal cross-section (FIG. 6*b*) of a propellant charge of an ammunition cartridge according to an embodiment of the invention.
Figure 6B:
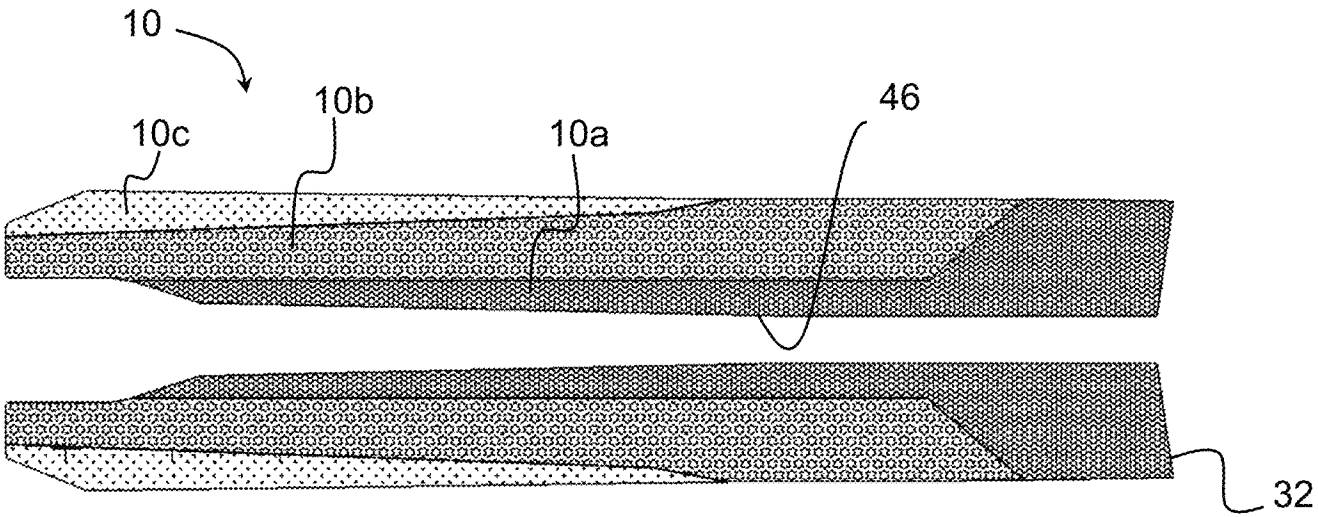

In the embodiment illustrated in FIGS. 6*a*, 6*b*, the propellant charge portions are arranged stacked in both an axial and radial direction (i.e. concentrically) such that combustion of the successive charge portions 10*a*, 10*b*, 10*c* occurs in an overlapping manner with the preceding charge portion. An advantage of this embodiment is that transition from the combustion of one charge portion to the next charge portion is gradual and thus provides a smooth gradual or continuous change in the combustion characteristics of the propellant charge over time.

Figure 5B:
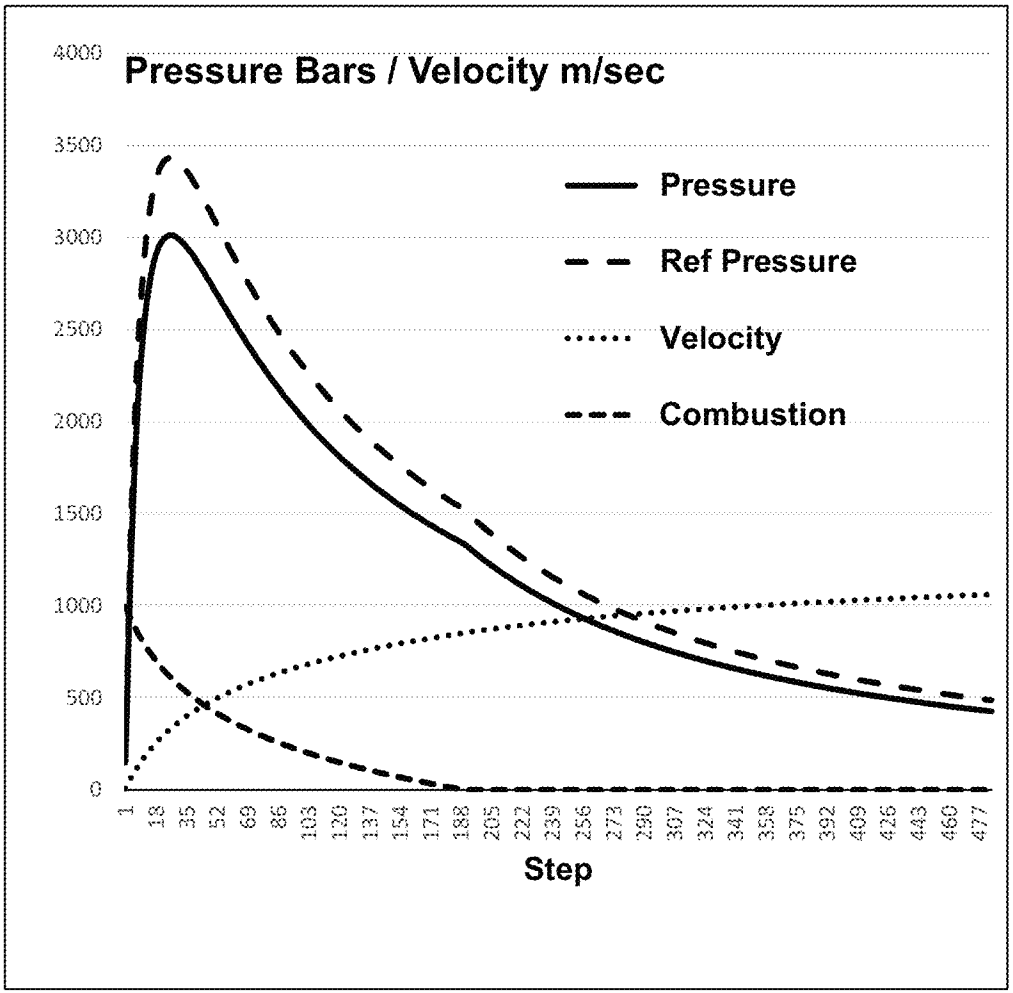
FIG. 5*b* is a graphical representation of the pressure, velocity and combustion profiles of a simulated combustion process using a single propellant with an ignition device located in the front part of the cartridge according to an embodiment of the invention and also showing the pressure profile for a conventional single propellant charge for comparison.
Figure 5C:
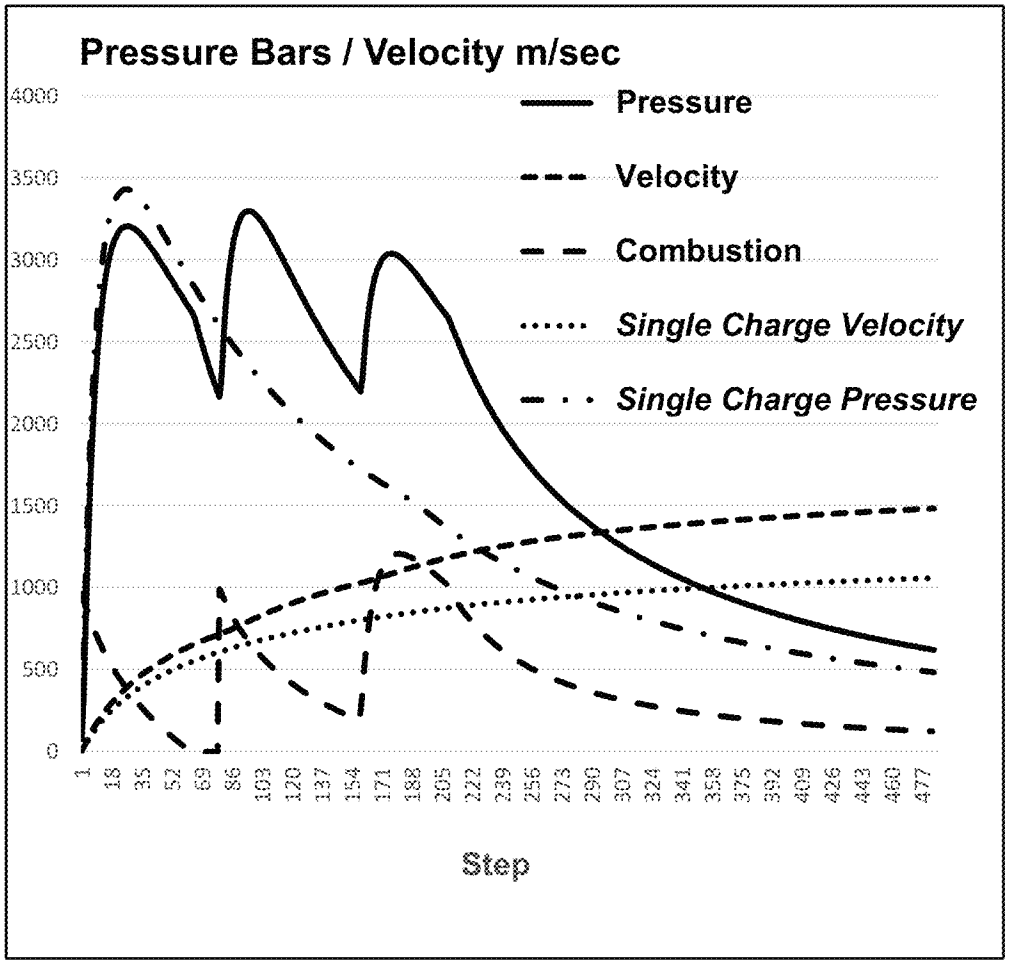
FIG. 5*c* is a graphical representation of the pressure, velocity and combustion profiles of a simulated combustion process using three successive propellant charges with an ignition device located in the front part of the cartridge according to an embodiment of the invention, and also showing curves for a convention single propellant charge for comparison.

If a combustible separation layer, not represented here, are placed between the plurality of charge portions, combustion transfer may be regulated by the combustion characteristics of the combustible separation layer material. The different combustion characteristics of the different charge portions may be determined empirically or via electronic modelling, or both, to optimize the combustion process. In an optimal combustion process, gas production and therefore gas expansion is configured to maintain a pressure close to peak pressure over a large portion of the full travel of the projectile in the barrel of the weapon for which it is intended to be used, as illustrated in FIG. 5*c*. The peak pressure can be set at or close to the maximum allowable pressure.

A mathematical simulation of the interior ballistic presented in FIG. 5*c* compares the pressure and velocity profiles produced by a single traditional charge ignited in the base of the cartridge and the pressure and velocity profiles produced by the successive action of three propellant charges ignited in the afore part of the cartridge. This mathematical model illustrates a good qualitative demonstration of the benefits that can be derived from embodiments of the invention.

The different charge portions 10*a*, 10*b*, 10*c*, 10*d* may either be made of different materials or be made of the same material but with different properties such as density of packing constituted to influence the rate of combustion and production of gas from the combusting propellant substance.

The propellant charge portions may also have components that retard or accelerate the combustion process. In a variant as illustrated in FIG. 3*b* or 3*c*, the charge portions 10*a*, 10*b*, 10*c*, 10*d* may be separated by combustion speed regulation materials 62, 62*a*, 62*b* selected to either retard or to accelerate combustion and thus increase or decrease the rate of gas production. The separation layer of a combustion regulation material between different charge portions may of course also be implemented between charge portions of other shapes, for instance in the variant illustrated in FIG. 6*b* with concentrically arranged charge portions. The regulation material may include an inert material such as a thin plastic film or a small paper disc that simply retards the combustion process passing from one charge portion to the adjacent charge portion. The regulation material may include a combustible material, such as plastic propellants containing high-brisance crystalline explosives, with a higher combustion rate than the propellant charge substance, to accelerate combustion. The regulation material can be embedded in part in the preceding charge in order to transfer combustion to the next charge before the former one finishes burning. The regulation of ignition transfer among successive charges can also be realized by special coatings and/or treatments of their interfacing ends. Starches, gelatinizers, colloidal sprays and other binders can be advantageously used.

In general, it will be desirable to have a generally increasing rate of production of gas from the initial charge portion 10*a* towards the subsequent charge portions 10*b*, 10*c*, 10*d* in order to maintain a high substantially constant gas pressure within the expanding chamber behind the projectile as it accelerates along a gun barrel chamber. As the combustion of the hybrid charges 10*b*, 10*c*, 10*d* occur when the projectile is further down the barrel, they dispose of much a larger volume than in the case of a single charge. They can generate a much higher gas quantity without exceeding the pressure tolerance of the weapons as shown in FIG. 5*c* where the pressure, velocity and combustion profiles derived from a numerical simulation of the interior ballistic process involving three propellant charges demonstrates that the muzzle velocity, and the range, can be substantially increased without exceeding the pressure tolerance of the weapon. The optimal proportions of materials and rates of acceleration may be determined by experimental and empirical tests as a function of the actual intended use since the acceleration properties of the projectile will depend also on the configuration of the weapon and the size of the projectile taking into account pressure losses in the weapon.

In an advantageous embodiment, the first charge portion 10*a* immediately adjacent the ignition end 24 of the ignition device 8 may be advantageously provided with a curved or concave face 32 directed towards the ignition end in order to promote a more evenly distributed spatio-temporal ignition of the propellant charge. The curvature of the front face of the propellant charge is essentially designed to receive the thermal energy of the ignition process at a substantially even time. Such a configuration is possible with a propellant charge that is in a solid preform as previously discussed.

Although the propellant charge portions discussed here are illustrated as distinct separate portions, it will be appreciated that in variants it is possible to have a continuous transition of material properties or composition configured to change the rate of combustion and gas production.

Referring now to FIG. 4*b*, in an advantageous embodiment, the projectile may be further provided with a projectile booster charge 12 positioned adjacent a trailing end 76 of the projectile inside or behind the ignition charge. The trailing end of the projectile 6 may comprise a cavity 70 within which the projectile booster charge 12 is lodged. In variants however, the projectile booster charge may be positioned behind the projectile but not with a cavity of the projectile.

In an embodiment, the second ignition charge 56*b* is positioned adjacent the projectile booster charge 12 such that it is ignited before the main propellant charge 10 is ignited.

The booster charge 12 serves to propel the projectile in its initial displacement out of the cartridge casing 4, and optionally into the barrel (not represented here), subsequently followed by the ignition of the main propellant charge 10 generating the combustion gas that accelerates the projectile during its travel in the barrel of the weapon. The second ignition charge 56*b* may be separated by a thin film 48 from the propellant charge 10 in order to ensure that the booster charge 12 is ignited simultaneously or prior to the ignition of the propellant charge 10.

Figure 7:
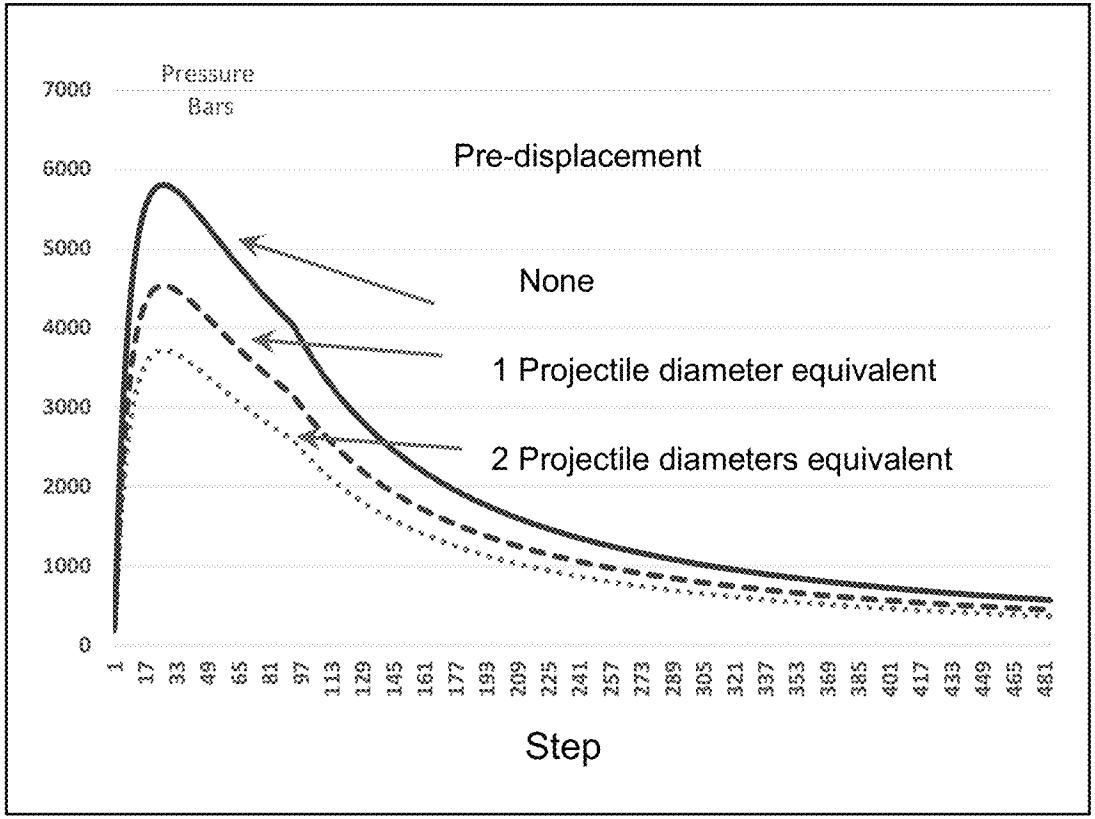
FIG. 7 is a graphical representation of pressure profiles of a simulated combustion process on an ammunition cartridge with a booster charge at the projectile, that causes a pre-displacement of the projectile prior to ignition of the propellant charge, according to an embodiment of the invention, and also showing a curve for a propellant charge without booster for comparison.

As illustrated in FIG. 7, the amount of pre-displacement of the projectile due to a booster charge prior to ignition of the propellant charge has an important effect on the peak pressure of in the weapon barrel. A pre-displacement of a distance of only one diameter created by a booster charge on the projectile reduces the peak pressure in this example to about 4500 bars from nearly 6000 bars without booster charge (i.e. without pre-displacement), and a pre-displacement of the projectile created by a booster charge of a distance of only two diameters of the projectile reduces the peak pressure in this example from nearly 6000 bars to about 3800 bars. A booster charge 12 that is only a very small charge compared to the propellant charges thus has an important effect on reducing the peak pressure and thus significantly improving the performance of the ammunition cartridge in terms of acceleration and range.

As illustrated in FIGS. 1*a*, 1*b* and 4*b*, in certain variants, the projectile booster charge 12 may be positioned within a tubular holder 66. The holder may advantageously serve to form a container that facilitates mounting and positioning of the combustible charge 12, 56*b* in the rear end of the projectile, in particular in a cavity 70 formed in a rear end of the projectile.

The use of the ignition charge 56*b*, with or without a projectile booster charge 12, to eject the projectile from the cartridge casing 4 and to force it in the barrel plays an advantageous role in the interior ballistic process. It provides the main propellant charge 10, or the first block of hybrid charges 10*a*, a much larger initial volume that helps reducing significantly the peak pressure generated by the combustion. As illustrated by the simulation presented in FIG. 5*b*, a small pre-displacement of the order of a caliber length increases the free volume by several digits and reduces inversely the pressure generated by the combustion.

In a variant, the projectile booster charge 12 may be included in or incorporated with the second ignition charge 56*b* that may thus function as both a projectile booster charge and an ignition charge to ignite the propellant charge 10. In the embodiment illustrated in FIGS. 1*a* and 1*b*, the charge mounted in the cavity 70 at the rear end of the projectile 6 may constitute a second ignition charge only, or a combined ignition and booster charge.

In the embodiment illustrated in FIGS. 1*a* and 1*b*, the tubular holder 66 mounted in the cavity 70 at the rear end of the projectile 6 may advantageously comprise an inwardly tapered or conical entry portion 63. In a first variant, the tapered entry portion may be substantially rigid. In a variant, the tapered entry portion may be deformable and configured to inwardly bias to close at least partially the rear end of the tubular holder if the projectile is pushed accidentally backwards into the casing as schematically illustrated in FIG. 1*b*. The tapered entry portion advantageously enhances safety against accidental ignition of the second ignition charge 56*b*. The tapered or conical entry portion 63 may, in a variant (not shown), be configured to abut against an end of the guide channel 28 in such a manner as to cause the movable portion of the guide channel to move axially rearwardly.

In various embodiments, the movable portion of the guide channel by means of telescopic assembly, pliable material portion, or a frangible interconnection, ensures that if the projectile is accidentally rearwardly pushed into the cartridge casing, the end of the guide channel will not contact the ignition charges 56*a*, 56*b* nor any booster charge 12, or alternatively will not contact the ignition charges 56*a*, 56*b*, 12, with sufficient impact force to ignite them. In case of variants with an ignition pin, the ignition pin is sufficiently short to prevent contact with the ignition charges 56*a*, 56*b* if the projectile is accidentally rearwardly pushed into the cartridge casing.

LIST OF REFERENCES IN THE DRAWINGS

Ammunition cartridge 2
Casing 4
Base 14
rim 34
Annular groove 36
Base wall 50
Tubular connection portion 52
Tubular sleeve 16
neck portion 38
taper 40
edge 42
base end 33
projectile end 35
Projectile 6
Tip 18
Centre portion 44
Base 20
Trailing end 76, 76'
Cavity 70
Tail fins 64
Ignition device 8
Point of ignition 23
Ignition cap 22
Base wall portion
Side wall portion
Transmission tube/Guide channel 28
Fixed portion 28*a*
Base portion 27
Telescopic portion 28*b*
Ignition pin 26
Nozzles 58
Ignition charge 56
Actuation end 54
Ignition end 24
Propellant charge 10
propellant charge portions (first, second, third . . . ) stacked 10*a*, 10*b*, 10*c*, 10*d*
loose Powder, granules,
Solid preform 30
Concave face 32
Central passage 46
Charge timer 62, 62*a*, 62*b*
Projectile booster charge 12
Protective film 48
Holder 66
Tapered (conical) entry portion 63

The invention claimed is:

1. Ammunition cartridge for rifles and handheld firearms, comprising:

a rigid casing including a tubular sleeve and a base closing an end of the casing, a projectile mounted at another end of the casing, a propellant charge contained inside the casing, and an ignition device arranged to ignite the propellant charge at a point of ignition distal from the base and proximal the projectile, the ignition device comprising a first ignition charge positioned in an ignition cap located in the base actuable by means of a firing pin or hammer impacting the ignition cap, wherein the ignition device further comprises a guide channel extending from the ignition cap to an ignition end proximal the projectile, the guide channel configured to channel an ignition charge under combustion to one or more nozzles at said ignition end, or to guide an ignition pin to said ignition end to ignite a second ignition charge mounted proximal the projectile, and wherein the guide channel comprises a movable portion configured to retract upon accidental insertion of the projectile into the casing to prevent accidental ignition of the propellant due to impact by the guide channel on the propellant upon accidental backward pushing of the projectile into the rigid casing.

2. Ammunition cartridge according to claim 1, wherein the guide channel comprises a fixed portion and a movable portion coupled to the fixed portion.

3. Ammunition cartridge according to claim 2, wherein the movable portion is axially slidably mounted on the fixed portion.

4. Ammunition cartridge according to claim 2, wherein the movable portion is connected to the fixed portion via a frangible or pliable coupling.

5. Ammunition cartridge according to claim 1, wherein the propellant charge comprises a plurality of portions of different composition or different densities with different combustion characteristics, in particular that retard or accelerate the combustion process.

6. Ammunition cartridge according to claim 1, wherein the propellant charge comprises a plurality of portions separated by at least one combustion speed regulation material selected to either retard or to accelerate combustion.

7. Ammunition cartridge according to claim 1, wherein the propellant charge is in a solid self-supporting preform, comprising a combustion powder held together with a binding material.

8. Ammunition cartridge according to claim 7, wherein the propellant charge comprises a concave face facing towards the point of ignition.

9. Ammunition cartridge according to claim 1, further comprising a combustible charge positioned adjacent a trailing end of the projectile, the combustible charge forming either a projectile booster charge and/or the second ignition charge.

10. Ammunition cartridge according to claim 9, wherein said combustible charge is positioned in a cavity in the trailing end of the projectile.

11. Ammunition cartridge according to claim 9, wherein said combustible charge is mounted in a tubular holder.

12. Ammunition cartridge according to claim 11, wherein the tubular holder comprises a tapered or conical entry portion at a rear end.

13. Ammunition cartridge according to claim 1, wherein the point of ignition is separated by a thin film from the propellant charge.

14. Ammunition cartridge according to claim 1, wherein the casing is made of at least two parts including the base and the tubular sleeve that are assembled together.

15. Ammunition cartridge according to claim 14, wherein said base and tubular sleeve are welded together.

16. Ammunition cartridge according to claim 1, wherein, the guide channel comprises a nozzle directed axially towards a rear end of the projectile.

17. Ammunition cartridge according to claim 16, wherein the rear end of the projectile is configured to bounce the ignition charge under combustion backwards off the rear end and on to a front surface of the propellant to ignite it.

* * * * *